US010214929B2

(12) United States Patent
Stone, Jr.

(10) Patent No.: US 10,214,929 B2
(45) Date of Patent: Feb. 26, 2019

(54) FLOATING SWIMMING POOL COVER

(71) Applicant: David B. Stone, Jr., Williamsport, PA (US)

(72) Inventor: David B. Stone, Jr., Williamsport, PA (US)

( * ) Notice: Subject to any disclaimer, the term of this patent is extended or adjusted under 35 U.S.C. 154(b) by 0 days.

(21) Appl. No.: 15/389,914

(22) Filed: Dec. 23, 2016

(65) Prior Publication Data

US 2017/0198486 A1 Jul. 13, 2017

Related U.S. Application Data

(60) Provisional application No. 62/275,851, filed on Jan. 7, 2016.

(51) Int. Cl.
*E04H 4/10* (2006.01)

(52) U.S. Cl.
CPC ..... *E04H 4/101* (2013.01)

(58) Field of Classification Search
CPC ..... E04H 4/101
USPC ..... 4/502
See application file for complete search history.

(56) References Cited

U.S. PATENT DOCUMENTS

| | | | |
|---|---|---|---|
| 4,324,370 | A | 4/1982 | Guard et al. |
| 4,411,031 | A | 10/1983 | Stolar |
| 4,426,995 | A | 1/1984 | Wilson |
| 4,459,711 | A | 7/1984 | Sartain et al. |
| 4,466,143 | A | 8/1984 | Lamb |
| 4,858,253 | A | 8/1989 | Lamb |
| 4,939,798 | A | 7/1990 | Last |
| 5,184,356 | A | 2/1993 | Lof et al. |
| 5,516,386 | A | 5/1996 | Savarese |
| 5,524,302 | A | 6/1996 | Ragsdale et al. |
| 5,901,770 | A | 5/1999 | Belpaume et al. |
| 5,927,042 | A | 7/1999 | Last |
| 6,014,778 | A | 1/2000 | Varnado |
| 6,026,522 | A | 2/2000 | Last |
| 6,508,247 | B1 | 1/2003 | Karales |
| 6,513,175 | B2 | 2/2003 | Bertoni |
| 6,618,869 | B1 | 9/2003 | Jacobs |
| 6,871,362 | B1 | 3/2005 | Zell |
| 7,493,933 | B2 | 2/2009 | Li |

(Continued)

FOREIGN PATENT DOCUMENTS

| | | |
|---|---|---|
| EP | 2201869 | 6/2010 |
| FR | 2867498 | 9/2005 |

(Continued)

*Primary Examiner* — Christine J Skubinna
(74) *Attorney, Agent, or Firm* — Wendy W. Koba

(57) ABSTRACT

A pool cover apparatus includes a sheet of corrugated polyethylene as a vapor barrier, where the sheet is wound onto a storage shaft when not in use. A drive shaft is disposed in a spaced-apart relationship with the storage shaft. When it is desired to deploy the sheet to cover the surface of a pool, the sheet passes over the drive shaft and the corrugations on the polyethylene sheet engage with the teeth on the drive shaft. Thus, as the drive shaft rotates, it causes the vapor barrier sheet to continue to move out and away from the shafts and cover the pool. Conversely, when it is desired to remove the sheet from the pool, the storage shaft is engaged, rotating in a manner that functions as a take-up reel and winds the vapor barrier sheet up on the shaft for storage.

13 Claims, 4 Drawing Sheets

(56) References Cited

U.S. PATENT DOCUMENTS

| | | | | |
|---|---|---|---|---|
| 8,418,280 | B2 * | 4/2013 | Schwerzmann | E04H 4/082 242/390.8 |
| 2001/0023506 | A1 | 9/2001 | Mathis et al. | |
| 2004/0064882 | A1 * | 4/2004 | Bartlett | E04H 4/103 4/502 |
| 2005/0102745 | A1 * | 5/2005 | Last | E04H 4/082 4/502 |
| 2010/0170032 | A1 * | 7/2010 | Sproatt | E04H 4/101 4/502 |
| 2010/0218756 | A1 | 9/2010 | Erez | |
| 2014/0000021 | A1 * | 1/2014 | Scheps | E04H 4/101 4/498 |

FOREIGN PATENT DOCUMENTS

| | | |
|---|---|---|
| JP | 06108763 | 4/1994 |
| WO | WO 2005118983 | 12/2005 |

* cited by examiner

10

FLOATING SWIMMING POOL COVER

CROSS-REFERENCE TO RELATED APPLICATIONS

This application claims the benefit of U.S. Provisional Application Ser. No. 62/275,851, filed Jan. 9, 2016 and herein incorporated by reference.

TECHNICAL FIELD

The present invention relates to a floating swimming pool cover useful in reducing evaporation and retaining heat and, more particularly, to a floating cover formed of corrugated polyethylene, with the corrugations formed along the surface that contacts the water, creating a vapor barrier.

BACKGROUND OF THE INVENTION

Swimming pools lose a significant amount of heat and water through surface evaporation. To maintain a comfortable temperature in the pool, as well as to keep a relatively consistent water level, it is necessary to frequently add both water and heat to the pool. This can not only add considerable expense, but may also shorten the season during which the pool is usable. It is known to use a removable cover that functions as a vapor barrier to reduce evaporation. Similar vapor barriers are also beneficial for use with indoor pools, where evaporated water not only requires adding heat to the pool, but also produces humidity issues in the pool room.

One exemplary type of vapor barrier is formed of a type of flexible bubble wrap, similar in form to packing material. While useful for relatively small pools, the effort required to cover larger, competition-sized pools is problematic. That is, the covers are challenging to put on and take off as they often do not hold their shape or wind up "true". And even if it is possible to evenly roll up a cover of such an extensive size, it is difficult to find a place to store the cover where it isn't an eyesore (and where it is protected when not in use).

Other types of pool covering have been developed. In one case, a plurality of individual, floating plastic pads is used, where a multiple number of pads are positioned on the surface (obviously, larger pools needing a larger number of these pads). Since they need to be individually placed and removed, their use is time-consuming. Again, these pads present storage problems.

Some systems utilize a cover that is attached to a pair of tracks that extend along the length of the pool, where the cover is moved via a cable-driven system to slide along the tracks and cover the pool. While effective, this type of configuration is obviously expensive and cannot be used on large pools.

Thus, a need remains for a relatively simple and efficient pool cover that may be quickly and easily placed on a pool and function to reduce evaporation and retain heat, using a system of covering/uncovering that avoids the various problems of the prior art.

SUMMARY OF THE INVENTION

The needs remaining in the prior art are addressed by the present invention, which relates to a floating swimming pool cover useful in reducing evaporation and retaining heat and, more particularly, to a floating cover formed of corrugated polyethylene, with the corrugations formed along the surface that contacts the water, creating a vapor barrier.

In accordance with an exemplary embodiment of the present invention, the corrugated polyethylene pool cover (which is flexible) is wound onto a storage shaft when not in use to cover a pool. A drive shaft is disposed in a spaced-apart relationship with the storage shaft. When it is desired to deploy the cover over the surface of a pool, the cover passes over the drive shaft and the corrugations on the polyethylene sheet engage with gear teeth on the drive shaft. Thus, as the drive shaft is rotated, the cover is pulled off the storage shaft and pushed out and away from the shafts and onto the pool. Conversely, when it is desired to remove the cover from the pool, the storage shaft is rotated in a manner that functions as a take-up reel and allows the cover to be pulled off of the pool and wound up on the storage shaft.

In a preferred embodiment of the present invention, an external drive motor is used to control the operation of both the drive shaft and the storage shaft. However, it is to be understood that conventional manual operations may be used to crank the appropriate shaft so as to either "pay out" or "take up" the cover.

In an exemplary embodiment of the present invention, the drive shaft may be covered with a piece of polyethylene having the same corrugations as the pool cover, these corrugations functioning as the gear teeth. A conventional drive shaft with machined teeth (or any other suitable type of teeth) may also be used.

One particular embodiment of the present invention includes an outer housing, with both the storage shaft and the drive shaft formed as components within the housing. A hinged ramp may be included in a specific configuration of the outer housing, where the ramp bridges the distance between the housing and the edge of a given pool and serves as a platform to support the movement of the cover between the drive shaft and the pool, ensuring that the edge of the cover is launched onto the water's surface.

An additional pressure shaft may be included in any embodiment of the present invention, where the pressure shaft is disposed over the drive shaft and positioned such that the cover is threaded between the pressure shaft and the drive shaft. In this manner, the cover is more likely to remain in contact with the drive shaft, where the rotation of the drive shaft urges the cover forward and onto the surface of the pool.

Configurations of the present invention that utilized motorized control of the rotation of the storage shaft and drive shaft may include the use of limit switches that sense when the entire cover has been played out over the surface (and thus turning "off" the drive shaft) and sense when the entire cover has been removed from the pool (and thus turning "off" the storage shaft). A remote control feature may be added to this motorized power source as well.

One particular embodiment of the present invention may be defined as a pool cover apparatus comprising a vapor barrier sheet formed of a flexible material, the vapor barrier flexible material for covering a defined surface of a and including a corrugated lower surface for contacting the water when in place on the pool, a storage shaft for supporting the vapor barrier sheet when not in use (the vapor barrier sheet wound upon the storage shaft in this condition) and a drive shaft disposed in relation to the storage shaft such that as the vapor barrier sheet is unwound from the storage shaft, it passes over the drive shaft and onto the pool, the drive shaft including gear teeth that mate with the corrugated lower surface of the vapor barrier sheet such that as the drive shaft is rotated, the corrugated lower surface of the vapor barrier sheet engage with the gear teeth and impart forward movement of the sheet.

Other and further aspects and embodiments of the present invention will become apparent during the course of the following discussion and by reference to the accompanying drawings.

BRIEF DESCRIPTION OF THE DRAWINGS

Referring now to the drawings where like numerals represent like parts in several views.

DETAILED DESCRIPTION

Figure 1:
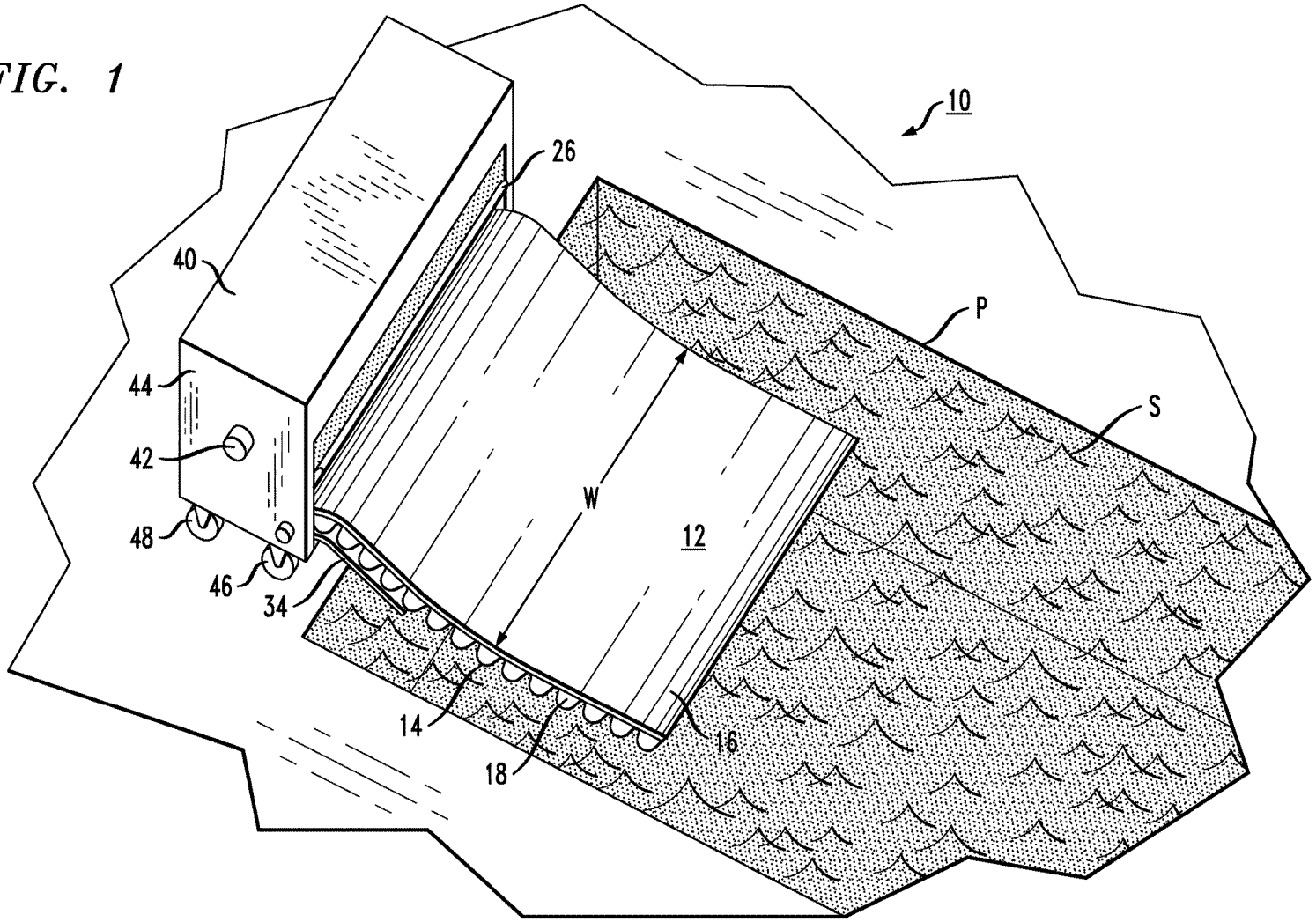
FIG. 1 illustrates the pool cover apparatus of the present invention as located in position along an edge of a pool, where in this view a portion of the vapor barrier sheet has begun to unwind from the apparatus and positioned over the pool surface.

FIG. 1 illustrates an exemplary floating pool cover apparatus 10 formed in accordance with the present invention. In the view of FIG. 1, the cover is partially deployed (that is, in the process of being played out) onto a pool P. More particularly, the cover is being deployed so as to float on water surface S within pool P. Apparatus 10 is shown as being positioned at an edge of pool P. It is contemplated that a particularly advantageous embodiment of the present invention is to utilize an apparatus 10 that is sized to cover an individual lane of a pool (for example, an indoor pool of a specific length for competitive swimming). When used in this context, a multiple number of the same apparatus may be lined up along the edge of the pool, with each cover apparatus 10 used to cover an individual lane.

Figure 2:
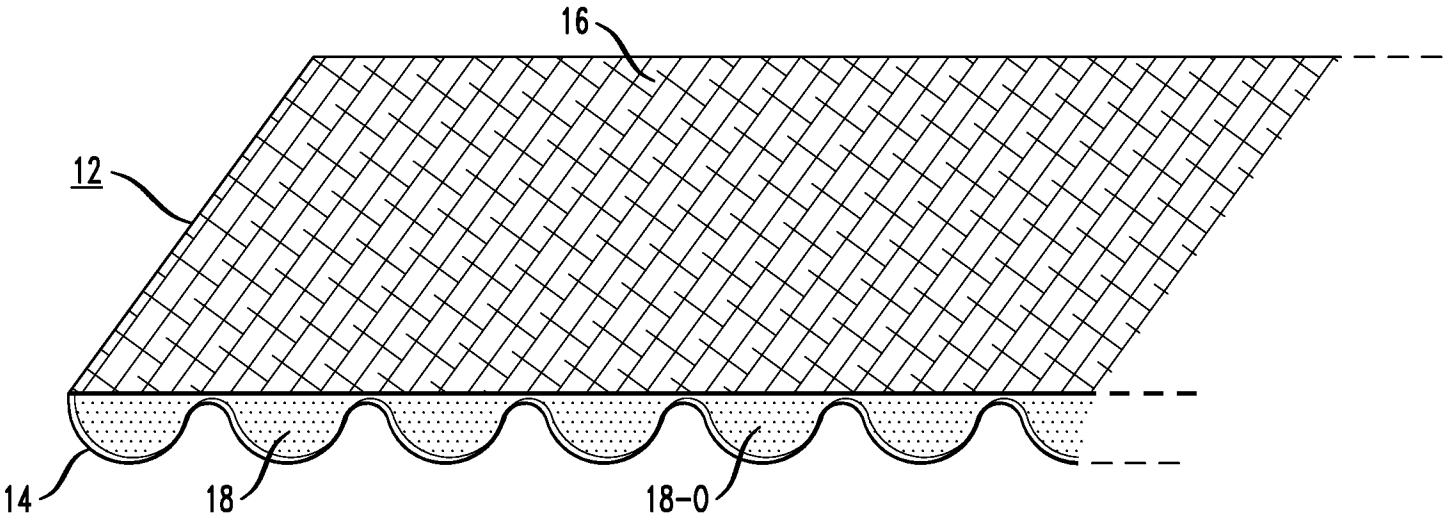
FIG. 2 is an isometric view of an exemplary corrugated polyethylene material that may be used to form the vapor barrier sheet.

As will be discussed in detail below, cover apparatus 10 includes a vapor barrier sheet 12 that is formed of a flexible material (preferably, polyethylene) having a corrugated surface. FIG. 2 is an isometric view of a section of vapor barrier sheet 12. In this case, sheet 12 is formed of multiple layers of polyethylene material fused together in a known fashion. In the particular embodiment of FIG. 2, sheet 12 is shown as include a relatively smooth top layer 16, with a corrugated polyethylene layer 14 attached across a surface of layer 16.

As mentioned above, corrugated polyethylene layer 14 includes a series of corrugations 18 disposed in parallel across the width W of sheet 12. In accordance with the present invention, the open end faces 18-O of the corrugations are filled, joined together, or in some manner pinched close so as to prevent water from entering these openings and weighting down vapor barrier sheet 12. The air pockets formed by closing end faces 18-O provides buoyancy and stiffness to the cover, while allowing the sheet to retain sufficient flexibility to be rolled up when not in use. While the specific embodiment of FIG. 2 illustrates a "multilayer" configuration, it is to be understood that a single sheet of polyethylene formed to include corrugations along one surface may also be used in the pool cover system of the present invention.

Figure 3:
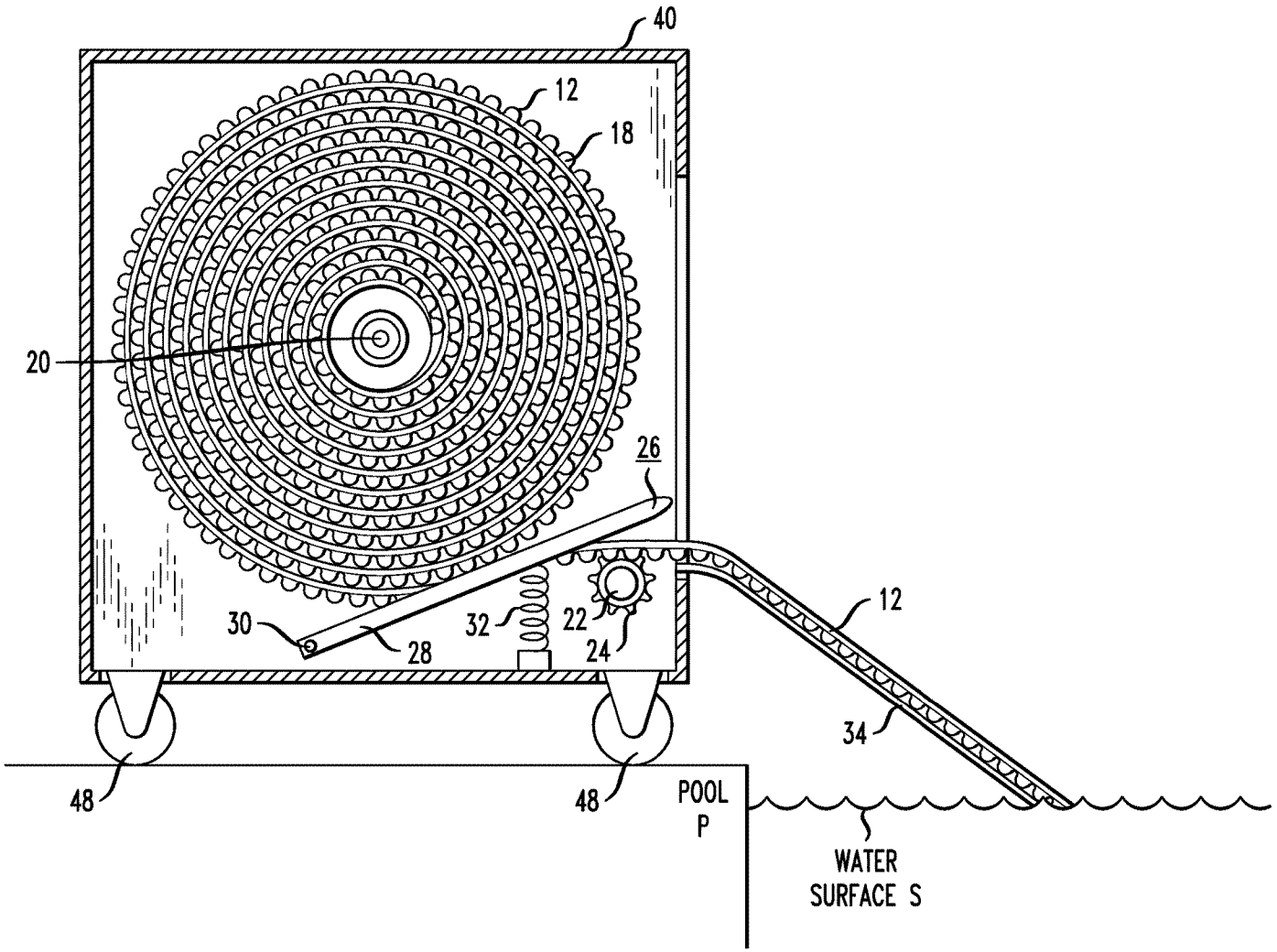
FIG. 3 is a cut away side view of the inventive apparatus, showing the vapor barrier sheet in place on the storage shaft, and threaded between the drive shaft and the pressure shaft as it exits the housing.

FIG. 3 is a cut-away side view of cover apparatus 10, which best illustrates the inner workings of apparatus 10 as used to control the deployment (i.e., "pay out") of sheet 12 onto pool surface S, as well as control the removal (retraction) of sheet 12 from pool surface S. For the purposes of the following discussion, it is useful to also refer back to FIG. 1 during the description of the individual components of apparatus 10 as shown in FIG. 3.

Vapor barrier sheet 12 is shown in FIG. 3 as being wound on a storage shaft 20. A drive shaft 22 is disposed in relation to storage shaft 20 so that sheet 12 will contact drive shaft 22 as it is unrolled (that is, as storage shaft 20 rotates). In accordance with the teachings of the present invention, drive shaft 22 is formed to include gear teeth 24 that mate with corrugations 18 of vapor barrier sheet 12. Therefore, as drive shaft 22 is powered (either using a motor or manually) to rotate, the motion of gear teeth 24 will encourage the forward movement of vapor barrier sheet 12 off of storage shaft 20 and onto water surface S of pool P. Gear teeth 24 can be formed by directly machining (or otherwise manufacturing) the proper depth and spacing of indentations around the surface of drive shaft 22. Alternatively, a section of the material forming vapor barrier sheet 12 may be disposed to cover the outer surface of drive shaft 22 and positioned with corrugations 18 exposed; in this manner, the exposed corrugations will easily mesh with the corrugations on the actual sheet and enable its movement outward and onto the pool surface.

In accordance with the present invention, therefore, the rotation of drive shaft 22 functions to deploy vapor barrier sheet 12, extending sheet 12 across water surface S. Vapor barrier sheet 12 is wound on storage shaft 20 such that as it begins to deploy, lower corrugated surface 14 of sheet 12 contacts the water, with corrugations 18 floating on the surface. The rotation of drive shaft 22 can be accomplished by using a motorized system as the power source. Alternatively, a manual system utilizing a crank handle attached to drive shaft 22 may be used to "power" the shaft (and/or may serve as a back-up when other power sources are not available).

Continuing with the description of FIG. 3, when it is desired to remove vapor barrier sheet 12 from water surface S, storage shaft 20 is activated to rotate, thus winding up sheet 12 in a controlled manner. Advantageously, corrugations 18 assist in retaining sheet 12 aligned as it engages gear teeth 24 on drive shaft 22. Again, a motorized unit can be used as the power source to activate storage shaft 20, or hand crank mechanism may be attached to shaft 20 and used to create the rotation.

The specific embodiment of the present invention as shown in FIG. 3 also includes a pressure shaft 26 disposed to maintain vapor barrier sheet 12 in contact with drive shaft 22. In particular, pressure shaft 26 includes a lever arm 28 attached to sidewalls 44 by a pivot member 30. A spring 32 is attached near the opposing end of lever arm 28, providing the force required to keep pressure shaft 26 pushing vapor barrier sheet 12 onto drive shaft 22. Thus, as vapor barrier sheet 12 is threaded between pressure shaft 26 and drive shaft 22, the tension created by spring 32 forces sheet 12 down onto drive shaft 22, allowing for corrugations 18 of sheet 12 to remain engaged with gear teeth 24 of drive shaft 22.

This specific embodiment as shown in FIG. 3 further comprises a ramp 34 which extends downward from apparatus 10 and into pool P, facilitating the movement of vapor barrier sheet 12 from apparatus 10 and into the pool. Advantageously, the presence of ramp 34 serves to remove additional water from corrugations 18 when vapor barrier sheet 12 is being removed and wound onto storage shaft 20. In a preferable configuration, ramp 34 is hinged onto housing 40, and can be folded up against housing 40 when not in use.

Figure 4:
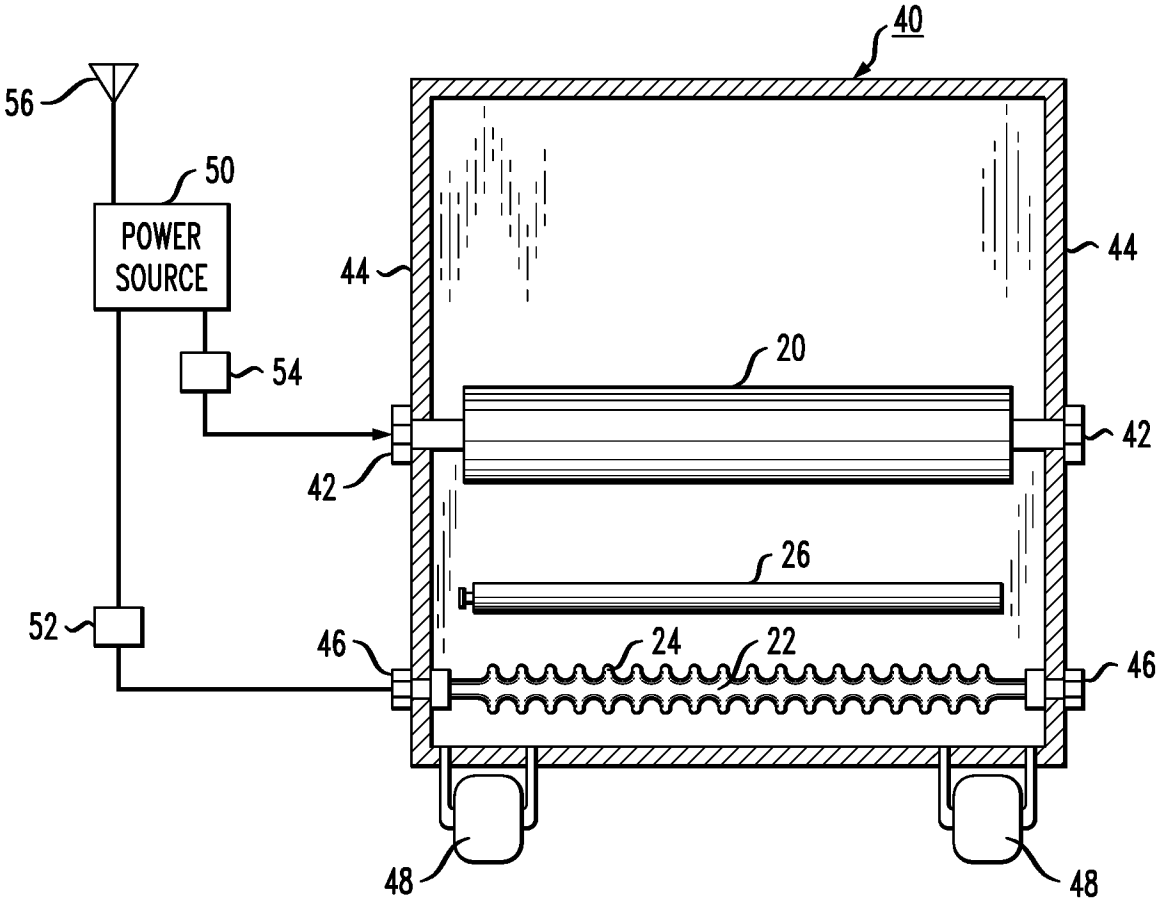
FIG. 4 is an alternative cut-away front view of the inventive apparatus, with the vapor barrier sheet removed to better illustrate the positioning of the various shafts, as well as an external power source that may be used to impart rotational motion to the drive shaft and storage shaft.

As mentioned above, a significant aspect of the present invention is that the specific components of cover apparatus 10 are stored within a housing that keeps vapor barrier sheet 12 protected when not in use, and can easily be stowed away. Referring to FIGS. 1 and 4, cover apparatus 10 is shown as including a housing 40 useful for configuration the various shafts in their proper positions, while also protecting sheet 12 when not in use. FIG. 4 is a cut-away side view of housing 40, without sheet 12 in place so that the positioning of storage shaft 20, drive shaft 22 and pressure shaft 26 is clearly shown.

Referring to FIG. 4, storage shaft 20 is shown as supported at opposite end terminations by a pair of bolts 42. In accordance with the present invention, storage shaft 20 passes through sidewalls 44 of housing 40, with bolts 42 located exterior to housing 40. Similarly, drive shaft 22 is shown as passing through sidewalls 44 of housing 40, with a pair of bolts 46 attached to opposing end terminations of drive shaft 22. Thus, in order to impart rotational movement to drive shaft 22 and deploy sheet 12 (not shown in FIG. 4) to cover the pool, a power source 50 (i.e., a motorized unit) can be attached to either one of bolts 46. The activation of power source 50 is used to create a rotational motion which translated through bolts 46 and attached drive shaft 22, causing drive shaft 22 to rotate. Power source 50 may similarly be coupled to bolts 42 of storage shaft 20 and used to initiate rotation of shaft 20 when it is desired to remove sheet 12 from the surface of the pool.

Power source 50 may also include limit switches. In particular, a first limit switch 52 may be used to sense when the entire sheet 12 has been unwound from storage shaft 20. At this occurrence, first limit switch 52 will stop the rotation of drive shaft 22 by turning off the power source. Similarly, a second limit switch 54 may be used to sense when the entire sheet 12 has been re-wound onto storage shaft 20. At this occurrence, second limit switch 54 will stop the rotation of storage shaft 20 by turning off the power source. In both cases, these limit switches provide the ability to control the rotational power delivered to the shafts and improve the performance of apparatus 10.

It is to be understood that the power source may operate via remote control, such as via RF signals received by an antenna 56. In this embodiment, an individual located within range of power source 50 may control the operation of apparatus 10 without needing to stand right next to the pool.

As mentioned above, a manual operation system may be used instead of power source 50 to control the operation of cover apparatus 10. That is, a crank arm may be attached to the proper bolts (i.e., either bolts 42 or bolts 46) and used to manually rotate the appropriate shaft to deploy or retract vapor barrier sheet 12.

Pressure shaft 26 is shown in FIG. 4 as being completely encased within housing 40, since there is no need to provide external rotational force to this shaft (FIG. 3 also shows the positioning of pressure shaft 26). Housing 40 is shown in FIG. 4 as resting on a set of casters 48, which are useful in allowing for apparatus 10 to be positioned near the pool when being used, and simply rolled away when not in use.

It is to be understood that the present invention is not limited to the above-described embodiments, but encompasses any and all variations that are contemplated as falling within the scope of the following claims.

What is claimed is:

1. A pool cover apparatus comprising a vapor barrier sheet formed of a flexible material, the vapor barrier sheet for covering a defined surface of a pool, the vapor barrier sheet including a corrugated lower surface for contacting the defined surface of the pool when in place on the pool;

a storage shaft for supporting the vapor barrier sheet when not in use, the vapor barrier sheet wound upon the storage shaft when not in use; and a drive shaft disposed in relation to the storage shaft such that as the vapor barrier sheet is unwound from the storage shaft, the vapor barrier sheet passes over the drive shaft and onto the defined surface of the pool, the drive shaft including gear teeth that mate with the corrugated lower surface of the vapor barrier sheet such that as the drive shaft is rotated, the corrugated lower surface of the vapor barrier sheet engages with the gear teeth and imparts forward movement of the vapor barrier sheet.

2. The pool cover apparatus as defined in claim 1 wherein the apparatus further comprises a pressure shaft disposed over the drive shaft such that the vapor barrier sheet passes between the pressure shaft and the drive shaft, the pressure shaft configured to apply pressure to a top surface of the vapor barrier sheet and maintain the corrugated lower surface in engagement with the gear teeth of the drive shaft.

3. The pool cover apparatus as defined in claim 1 wherein the apparatus further comprises a power source for imparting rotational movement to the drive shaft to automatically deploy the vapor barrier sheet from the apparatus.

4. The pool cover apparatus as defined in claim 3 wherein the power source imparts rotational movement to the storage shaft to initiate the process of removing the vapor barrier sheet from the pool and winding the vapor barrier sheet onto the storage shaft.

5. The pool cover apparatus as defined in claim 4 wherein the power source further comprises limit switches to control the rotational movement of the drive shaft and the storage shaft.

6. The pool cover apparatus as defined in claim 4 wherein the power source includes a remote control mechanism for activating the rotation of either the drive shaft or the storage shaft.

7. The pool cover apparatus as defined in claim 1 wherein the apparatus further comprises a ramp extension for supporting the vapor barrier sheet in a span between the exit of the apparatus and the defined surface of the pool.

8. The pool cover apparatus as defined in claim 1 wherein the drive shaft is formed to include gear teeth directly manufactured into its outer surface.

9. The pool cover apparatus as defined in claim 1 wherein the apparatus further comprises a housing for supporting the storage shaft and the drive shaft.

10. The pool cover apparatus as defined in claim 9 wherein the housing includes a plurality of casters disposed across its lower surface.

11. The pool cover apparatus as defined in claim 1 wherein the vapor barrier sheet comprises a plurality of layers of polyethylene material.

12. The pool cover apparatus as defined in claim 11 wherein the plurality of layers of polyethylene material include a top, flat layer and a bottom, corrugated layer, the top and bottom layers fused together.

13. The pool cover apparatus as defined in claim 12 wherein the bottom, corrugated layer comprises a plurality of corrugations disposed across the width of the layer, with open ends of each corrugation closed to create air pockets within the vapor barrier sheet.

* * * * *